US010229823B2

(12) United States Patent
Nishiguchi et al.

(10) Patent No.: US 10,229,823 B2
(45) Date of Patent: Mar. 12, 2019

(54) MASS SPECTROMETER

(71) Applicant: SHIMADZU CORPORATION, Kyoto-shi, Kyoto (JP)

(72) Inventors: Masaru Nishiguchi, Kyoto (JP); Daisuke Okumura, Kyoto (JP)

(73) Assignee: SHIMADZU CORPORATION, Kyoto-shi, Kyoto (JP)

( * ) Notice: Subject to any disclaimer, the term of this patent is extended or adjusted under 35 U.S.C. 154(b) by 0 days.

(21) Appl. No.: 15/750,362

(22) PCT Filed: Aug. 6, 2015

(86) PCT No.: PCT/JP2015/072390
§ 371 (c)(1),
(2) Date: Jul. 3, 2018

(87) PCT Pub. No.: WO2017/022125
PCT Pub. Date: Feb. 9, 2017

(65) Prior Publication Data

US 2018/0315588 A1 Nov. 1, 2018

(51) Int. Cl.
*H01J 49/00* (2006.01)
*H01J 49/06* (2006.01)
(Continued)

(52) U.S. Cl.
CPC ..... *H01J 49/067* (2013.01); *H01J 49/14* (2013.01); *H01J 49/24* (2013.01); *H01J 49/40* (2013.01)

(58) Field of Classification Search
CPC .. H01J 49/00; H01J 49/02; H01J 49/06; H01J 49/062; H01J 49/067; H01J 49/068;
(Continued)

(56) References Cited

U.S. PATENT DOCUMENTS

2004/0262512 A1* 12/2004 Tobita ..... H01J 49/044 250/288
2005/0199803 A1* 9/2005 Ueno ..... H01J 49/067 250/290
(Continued)

FOREIGN PATENT DOCUMENTS

GB 2481749 B 12/2013
JP 2000-340169 A 12/2000
(Continued)

OTHER PUBLICATIONS

Written Opinion for PCT/JP2015/072390, dated Sep. 8, 2015.
(Continued)

*Primary Examiner* — Jason McCormack
(74) *Attorney, Agent, or Firm* — Sughrue Mion, PLLC

(57) ABSTRACT

A mass spectrometer includes a collision cell (16) converging electrode (18), accelerating electrode (19) and front-side ion lens system (20) which is an electrostatic lens, which are all located within a medium-vacuum region, and a partition wall (22) for separating the medium-vacuum region from a high-vacuum region and an ion transport optical system (23) located within the high-vacuum region. Ions which have been extracted and accelerated by an accelerating electric field created between an exit electrode (16*a*) and the accelerating electrode (19) are focused into a micro-sized ion-passage opening (19*a*) by the converging electrode (18). The accelerating electrode (19) blocks a stream of gas, thereby decreasing the chance of contact of ions with gas particles behind the electrode. Additionally, the accelerating electric field imparts a considerable amount of kinetic energy to the ions, thereby preventing the ions from being dispersed even when they come in contact with the gas particles.

4 Claims, 3 Drawing Sheets

(51) Int. Cl.
*H01J 49/40* (2006.01)
*H01J 49/14* (2006.01)
*H01J 49/24* (2006.01)

(58) Field of Classification Search
CPC .. H01J 49/26; H01J 49/40; H01J 49/42; H01J 49/4205; H01J 49/421; H01J 49/4215; H01J 49/4245; H01J 49/426; H01J 49/427
USPC ..... 250/281, 282, 289
See application file for complete search history.

(56) References Cited

U.S. PATENT DOCUMENTS

2011/0121175 A1 5/2011 Yasuno et al.
2014/0361163 A1* 12/2014 Taniguchi ..... H01J 49/063 250/287
2016/0118235 A1* 4/2016 Fujita ..... H01J 49/0031 250/290

FOREIGN PATENT DOCUMENTS

JP 2002-110081 A 4/2002
JP 2005-276744 A 10/2005
JP 2011-108569 A 6/2011

OTHER PUBLICATIONS

International Search Report for PCT/JP2015/072390, dated Sep. 8, 2015.
Notification on Concerning Transmittal of International Preliminary Report on Patentability, dated Feb. 15, 2018.
Notification of Reasons for Refusal dated Nov. 6, 2018 issued by the Japanese Patent Office in counterpart application No. 2017-532340.

* cited by examiner

MASS SPECTROMETER

CROSS REFERENCE TO RELATED APPLICATIONS

This application is a National Stage of International Application No. PCT/JP2015/072390 filed Aug. 6, 2015.

TECHNICAL FIELD

The present invention relates to a mass spectrometer in which the configuration of a differential pumping system is adopted. In particular, it relates to a mass spectrometer having a high-vacuum chamber in which a time-of-flight mass separator, Fourier transform ion cyclotron resonance mass separator, or similar device is placed, as well as a medium-vacuum chamber containing a medium-vacuum atmosphere separated from the high-vacuum chamber by a partition wall having a small-sized ion-passage hole.

BACKGROUND ART

A mass spectrometer called the "Q-TOF mass spectrometer" is commonly known as one type of mass spectrometer. As described in Patent Literature 1 (or other documents), a Q-TOF mass spectrometer includes: a quadrupole mass filter for selecting an ion having a specific mass-to-charge ratio from ions originating from a sample; a collision cell for fragmenting the selected ion by collision induced dissociation (CID); and a time-of-flight mass separator for detecting product ions generated by the fragmentation after separating those ions according to their mass-to-charge ratios. As the time-of-flight mass separator, an orthogonal acceleration time-of-flight mass separator is adopted, which accelerates ions in an orthogonal direction to the direction of the injection of an ion beam and sends those ions into the flight space.

In the time-of-flight mass separator, if a flying ion comes in contact with residual gas, its flight path changes, and its time of flight also changes. Consequently, the mass-resolving power and mass accuracy become lower. To avoid this problem, time-of-flight mass separators are normally placed within a high-vacuum chamber maintained at a high degree of vacuum (on the order of $10^{-4}$ Pa). On the other hand, the collision cell for dissociating ions are continuously or intermittently suppled with CID gas, and this gas leaks from the collision cell. Therefore, the collision cell cannot be placed within the high-vacuum chamber in which the time-of-flight mass separator is located; the cell is placed within a medium-vacuum chamber which is separated from the high-vacuum chamber by a partition wall and has a higher level of gas pressure than the high-vacuum chamber. The product ions generated within the collision cell are transported into the high-vacuum chamber through an ion-passage hole formed in the partition wall separating the medium-vacuum chamber and the high-vacuum chamber. The ion-passage hole needs to be extremely small to maintain the degree of vacuum within the high-vacuum chamber. In order to make ions efficiently pass through such a small hole, an ion transport optical system for transporting the ions while shaping the cross-sectional form of the ion beam is placed between the collision cell and the partition wall.

A representative example of the ion transport optical system used in a mass spectrometer is a radio-frequency multipole ion guide disclosed in Patent Literature 2 (or other documents). A radio-frequency (RF) multipole ion guide is a device for transporting ions while oscillating the ions by a radio-frequency electric field in such a manner as to confine the ions within a specific space surrounded by a plurality of electrodes. In the case of an ion transport optical system which is placed within the medium-vacuum chamber due to the CID gas supplied to the collision cell as noted earlier, the collision of the ions with the gas must be considered. The collision of the ions with the gas produces a cooling effect which deprives the ions of energy. This cooling effect favors the converging of the ion beam in the RF multipole ion guide which traps ions by a radio-frequency electric field. In other words, the RF multipole ion guide is suitable for converging ions ejected from the collision cell and guiding them into the micro-sized ion-passage hole within the medium-vacuum chamber maintained at a comparatively high level of gas pressure. Therefore, in conventional Q-TOF mass spectrometers, RF multipole ion guides have been commonly used as the ion transport optical system located between the collision cell and the partition wall within the medium-vacuum chamber.

On the other hand, the ion transport optical system located between the partition wall having the ion-passage hole and the orthogonal accelerator of the time-of-flight mass separator within the high-vacuum chamber is primarily used to produce the effects of shaping the cross-sectional form of the ion beam as well as adjusting the kinetic energy possessed by the ions. These effects are essential because, if an ion with a large amount of kinetic energy is allowed to enter the orthogonal accelerator, the ejecting direction of the ion from the orthogonal accelerator may become excessively tilted from the orthogonal direction and cause the ion to miss the detector after passing through the flight space. Unlike the medium-vacuum chamber, the contact of ions with the gas barely occurs within the high-vacuum chamber, since there is practically no residual gas in this chamber. The ion-cooling effect by the collision with the gas will not occur, and the trapping of the ions by a radio-frequency electric field will scarcely work insignificantly. Therefore, in many cases, an electrostatic ion lens which controls the trajectory and kinetic energy of the ions by a DC electric field is used as the ion transport optical system located within the high-vacuum chamber.

Other than the Q-TOF mass spectrometer mentioned earlier, there are some types of mass spectrometers constructed as a differential pumping system for transporting ions from a medium-vacuum region of approximately 1 Pa to a high-vacuum region through an ion-passage hole formed in a partition wall. For example, the configuration of a differential pumping system similar to the Q-TOF mass spectrometer is adopted in a mass spectrometer in which an atmospheric pressure ion source, such as an electrospray ion source, is used as the ion source of a time-of-flight mass spectrometer. Another example is a Fourier transform ion cyclotron resonance mass spectrometer, in which residual gas may possibly produce adverse effects on the performance of the device, as in the case of the time-of-flight mass separator. Those types of mass spectrometers also commonly use the combination of a RF multipole ion guide located within a medium-vacuum region on the front side of a partition wall and an electrostatic ion lens located within the high-vacuum region on the rear side of the same wall, to transport ions across the two vacuum regions with different degrees of vacuum.

The RF multipole ion guide located within the medium-vacuum chamber or medium-vacuum region can transport ions with a high level of efficiency. However, it has a large number of electrodes, and those electrodes need to be shaped and arranged with a high level of mechanical accuracy.

Furthermore, the voltage source for applying voltages to the RF multipole ion guide is complex in configuration, since there are complex conditions concerning the voltages individually applied to the electrodes. Due to these factors, RF multipole ion guides are normally far more expensive than electrostatic ion lenses.

CITATION LIST

Patent Literature

Patent Literature 1: JP 2002-110081 A
Patent Literature 2: GB 2481749 B

SUMMARY OF INVENTION

Technical Problem

The present invention has been developed to solve such a problem. Its objective is to provide a mass spectrometer constructed as a differential pumping system including a partition wall having an ion-passage hole sandwiched between a medium-vacuum region and a high-vacuum region, the mass spectrometer being capable of achieving a high level of ion transmittance while allowing for the simplification of the electrode structure and voltage application conditions of the ion transport optical system located within the medium-vacuum region.

Solution to Problem

The present invention developed for solving the previously described problem is a mass spectrometer constructed as a differential pumping system including a medium-vacuum region and a high-vacuum region separated by a partition wall having an ion-passage hole, the mass spectrometer having an ion transport path for guiding ions from a front-side ion optical system located within the medium-vacuum region through the ion-passage hole into the medium-vacuum region to introduce the ions into a rear-side ion optical system located within the high-vacuum region, and the mass spectrometer including:

a) a front-side ion transport optical system which is an electrostatic ion lens located between the front-side ion optical system and the partition wall, including: an accelerating electrode having a micro-sized ion-passage opening and located on an entrance side of the front-side ion transport optical system, for extracting ions from the front-side ion optical system and accelerating the ions; and a converging electrode located between the accelerating electrode and the front-side ion optical system, for converging ions extracted from the front-side ion optical system so as to make the ions pass through the ion-passage opening of the accelerating electrode;

b) a rear-side ion transport optical system which is an electrostatic ion lens located between the partition wall and the rear-side ion optical system; and c) a voltage supplier for applying a direct voltage to each of the members constituting the front-side ion optical system, the front-side ion transport optical system, the partition wall, and the rear-side ion transport optical system, the voltage supplier configured to apply a voltage to each of the members so that: an accelerating electric field for accelerating ions is created within a space between the front-side ion optical system and the accelerating electrode; an electric field for converging ions is created near the converging electrode within the aforementioned space; a converging electric field for focusing ions into the ion-passage hole while maintaining the kinetic energy possessed by the ions is created within a space between the accelerating electrode and the partition wall; and a decelerating electric field for reducing the kinetic energy of the ions by an amount smaller than the kinetic energy imparted to the ions within the accelerating electric field is created within a space between the partition wall and the rear-side ion optical system.

The "medium-vacuum region" is a region in which the gas pressure is roughly within a range of 1-0.01 Pa. The "high-vacuum region" is a region in which the gas pressure is roughly at 0.001 ($=10^{-3}$) Pa or lower.

One mode of the mass spectrometer according to the present invention is a Q-TOF mass spectrometer in which the front-side ion optical system is a collision cell for fragmenting ions by collision induced dissociation, and the rear-side ion optical system is an orthogonal accelerator in an orthogonal acceleration time-of-flight mass separator.

Another mode of the mass spectrometer according to the present invention is a Q-FT mass spectrometer in which the front-side ion optical system is a collision cell and the rear-side ion optical system is a Fourier transform mass spectrometer.

Still another mode of the mass spectrometer according to the present invention is a time-of-flight mass spectrometer in which the front-side ion optical system is an ion-holding unit, such as a linear ion trap, the rear-side ion optical system is an orthogonal accelerator in an orthogonal acceleration time-of-flight mass separator, and an ion source is an atmospheric pressure ion source, such as an electrospray ion source.

In the mass spectrometer according to the present invention, ions which have exited the front-side ion optical system, such as a collision cell, are extracted from the front-side ion optical system by the accelerating electric field created within the space between the front-side ion optical system and the accelerating electrode, whereby a large amount of kinetic energy is imparted to the ions. The medium-vacuum region contains a greater amount of residual gas than the high-vacuum region which is separated from the former region by the partition wall. In particular, if the front-side ion optical system is a collision cell, there is a considerable amount of CID gas leaking from the collision cell due to the continuous or intermittent introduction of the CID gas into the collision cell. In the medium-vacuum region, such a gas moves toward the ion-passage hole formed in the partition wall. However, this gas cannot easily pass through the micro-sized ion-passage opening formed in the accelerating electrode. Thus, the amount of gas present within the space between the accelerating electrode and the partition wall can be decreased.

As just described, the ions pass through the front-side ion transport optical system behind the accelerating electric field after being given a considerable amount of kinetic energy from the accelerating electric field. Therefore, the ions will not be easily dispersed even if they collide with residual gas. The ions will be correctly focused onto a small area including the ion-passage hole by the converging electric field and efficiently pass through the same ion-passage hole. It is preferable to set the amount of kinetic energy imparted to the ions by the accelerating electric field so that the kinetic energy of the ions will certainly exceed the amount of energy that the ions must have when entering the rear-side ion optical system, even after the ions collide with the residual gas several times within the space between the accelerating electrode and the partition wall. Even if an excessive amount of kinetic energy is imparted to the ions by the accelerating electric field, the ions will be deprived of a portion of their kinetic energy by the decelerating electric field immediately after the ions are introduced through the ion-passage hole into the high-vacuum region in which there is practically no influence of the residual gas. Thus, the ions are controlled to have an appropriate amount of kinetic energy before they are introduced into the rear-side ion optical system, such as an orthogonal accelerator.

Advantageous Effects of the Invention

Thus, in the mass spectrometer according to the present invention, the accelerating electrode is located on the entrance side of the front-side ion transport optical system which has the effect of converging ions onto the ion-passage hole formed in the partition wall. This accelerating electrode blocks the gas stream moving in the same direction as the ions, while creating the accelerating electric field on its front side to give the ions a sufficient amount of kinetic energy to withstand collision with the residual gas. Thus, the ions can be efficiently transported by a simple electrostatic ion lens even within the medium-vacuum region in which the influence of the collision with the residual gas is not ignorable. As compared to the RF multipole ion guide which uses a radio-frequency electric field for transporting ions, the electrostatic ion lens has the advantage of simplifying the electrode structure and the configuration of the voltage source for applying voltages to the electrodes. The requirements concerning the dimensional and arrangement accuracies of the electrodes will also be less strict. Therefore, with the mass spectrometer according to the present invention, it is possible to increase the amount of ions to be sent into the high-vacuum region and thereby improve the sensitivity or accuracy of an analysis while achieving a decrease in the cost of the device.

DESCRIPTION OF EMBODIMENTS

A Q-TOF mass spectrometer as one embodiment of the present invention is hereinafter described with reference to the attached drawings.

Figure 1:
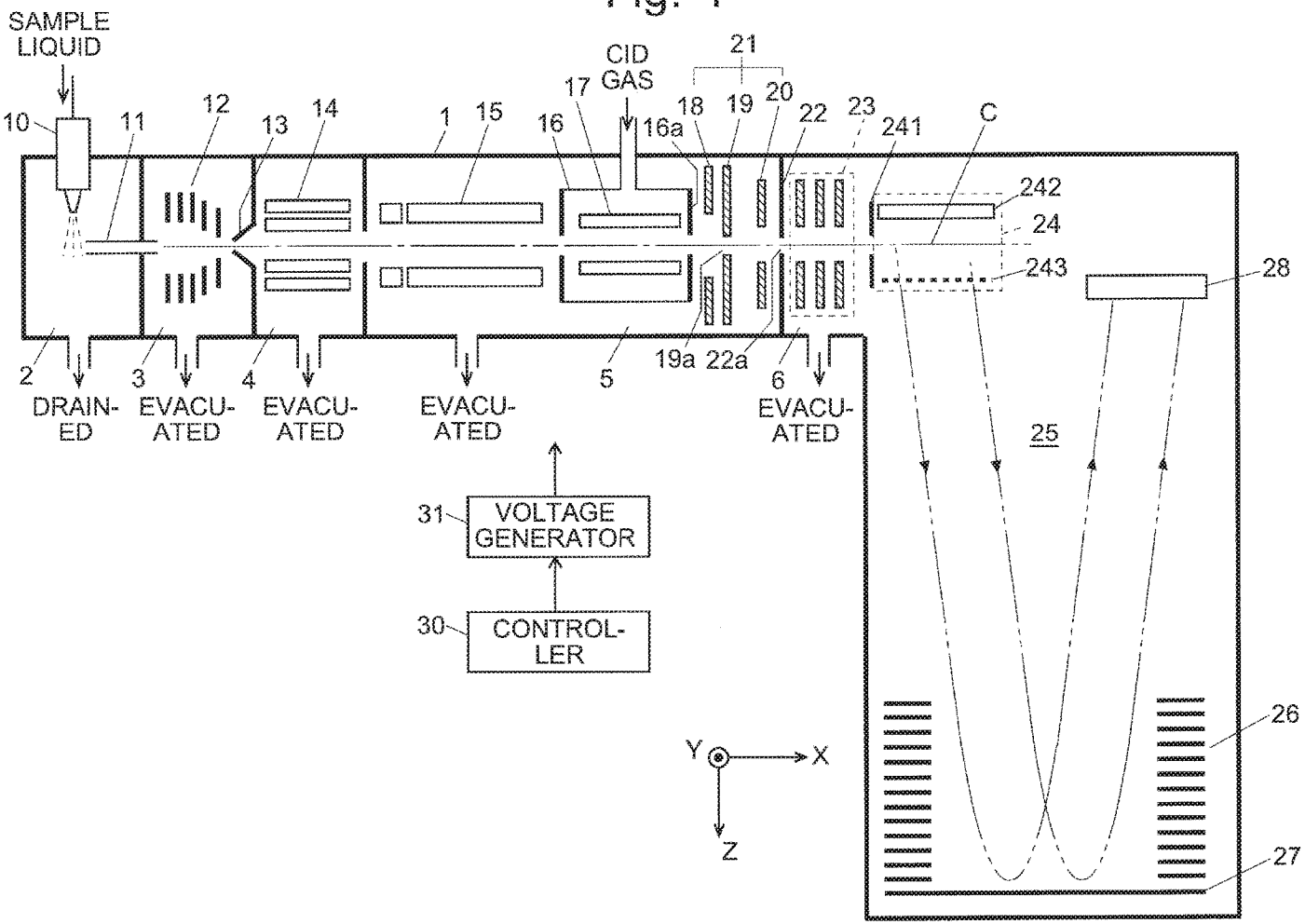
FIG. 1 is an overall configuration diagram of a Q-TOF mass spectrometer as one embodiment of the present invention.

FIG. 1 is an overall configuration diagram of the Q-TOF mass spectrometer in the present embodiment.

The Q-TOF mass spectrometer in the present embodiment has the configuration of a multistage differential pumping system. Specifically, it has a chamber 1 whose inner space is divided into an ionization chamber 2 maintained at substantially atmospheric pressure, a high-vacuum chamber 6 maintained at the highest degree of vacuum (i.e. at the lowest level of gas pressure), and three (first through third) intermediate vacuum chambers 3, 4 and 5 located between the two aforementioned chambers, with their degrees of vacuum increased in a stepwise manner. Though not shown, those chambers except the ionization chamber 2 are evacuated by a rotary pump, or the combination of a rotary pump and a turbo molecular pump.

The ionization chamber 2 is equipped with an ESI spray 10 for electrospray ionization (ESI). When a sample liquid containing a target compound is supplied to the ESI spray 10, droplets having an imbalanced polarity of electric charges given from the tip of the spray 10 are sprayed into ambience of substantially atmospheric pressure, and ions of compound origin are generated from those droplets. The various kinds of ions thereby generated are sent through a heated capillary 11 into the first intermediate vacuum chamber 3, where the ions are converged by the ion guide 12 and sent through a skimmer 13 into the second intermediate vacuum chamber 4. Those ions are further converged by an octapole ion guide 14 and sent into the third intermediate vacuum chamber 5.

The third intermediate vacuum chamber 5 contains a quadrupole mass filter 15 and a collision cell 16 in which a multipole ion guide 17 is provided. The various kinds of ions derived from the sample are introduced into the quadrupole mass filter 15. Only an ion having a specific mass-to-charge ratio corresponding to the voltages applied to the electrodes forming the quadrupole mass filter 15 is allowed to pass through the same filter. This ion is introduced into the collision cell 16 as a precursor ion. Due to the contact with the CID gas supplied from outside into the collision cell 16, the precursor ion undergoes dissociation, generating various kinds of product ions.

The third intermediate vacuum chamber 5 is separated from the high-vacuum chamber 6 by a partition wall 22. A front-side ion transport optical system 21, which includes a converging electrode 18, accelerating electrode 19 and electrostatic ion lens system 20, is located on the front side of the partition wall 22, while a rear-side ion transport optical system 23, which is an electrostatic ion lens system, is located on the rear side of the same wall. In addition to this rear-side ion transport optical system 23, the following elements are contained in the high-vacuum chamber 6: an orthogonal accelerator 24 which functions as the ion ejection source, a flight space 25 provided with a reflector 26 and a back plate 27, as well as an ion detector 28. The orthogonal accelerator 24 includes an ion entrance electrode 241, push-out electrode 242 and extracting electrode 243.

As will be described later in detail, the product ions generated within the collision cell 16 travel along the ion beam axis C via the converging electrode 18, accelerating electrode 19 and electrostatic ion lens system 20. After passing through a micro-sized ion-passage hole 22*a* formed in the partition wall 22, the ions are introduced into the orthogonal accelerator 24 via the rear-side ion transport optical system 23.

The ions introduced into the orthogonal accelerator 24 in the X-axis direction begin to fly by being accelerated in the Z-axis direction by the voltages applied to the push-out electrode 242 and the extracting electrode 243 at a predetermined timing. The ions ejected from the orthogonal accelerator 24 initially fly freely and are then repelled by a reflecting electric field created by the reflector 26 and the back plate 27. Subsequently, the ions once more fly freely and eventually arrive at the ion detector 28. The time of flight from the point in time where an ion leaves the orthogonal accelerator 24 to the point in time where it arrives at the ion detector 28 depends on the mass-to-charge ratio of the ion. Accordingly, a data processor (not shown), which receives detection signals from the ion detector 28, converts the time of flight of each ion into its mass-to-charge ratio and creates a mass spectrum which shows the relationship between the mass-to-charge ratio and the signal intensity based on the calculated result.

In conducting an analysis as just described, a controller 30 sends control signals to a voltage generator 31 according to a previously determined sequence. Based on those control signals, the voltage generator 31 generates predetermined voltages and applies them to the electrodes and other related elements.

In the Q-TOF mass spectrometer according to the present embodiment, a mass spectrometric analysis of an ion which has not been dissociated, i.e. a normal mode of mass spectrometry, can also be performed by omitting the selection of an ion with the quadrupole mass filter 15 as well as the dissociating operation of ions within the collision cell 16.

The Q-TOF mass spectrometer in the present embodiment is characterized by the configuration of the ion optical system for transporting ions from the collision cell 16 to the orthogonal accelerator 24.

Figure 2A:
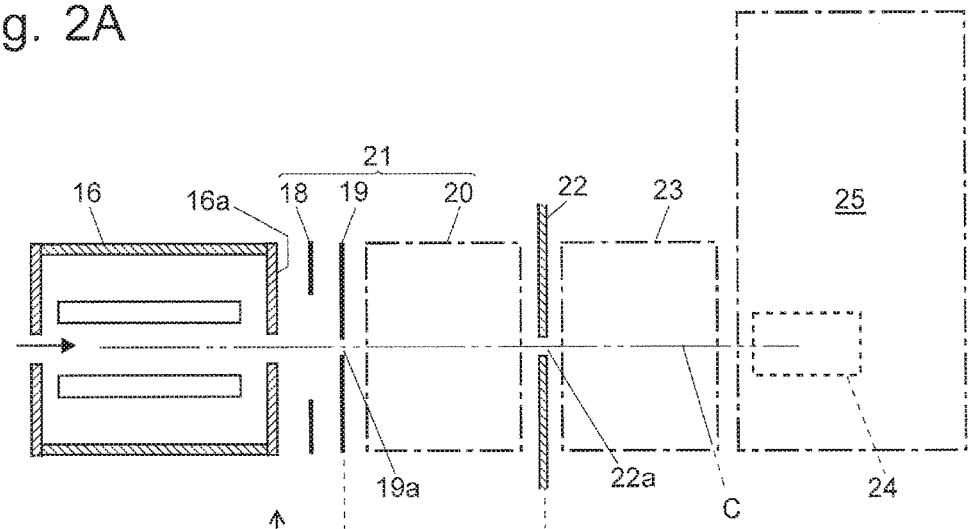
FIGS. 2A and 2B are diagrams showing the configuration of the ion optical system between the collision cell and the orthogonal accelerator as well as a change in the kinetic energy possessed by an ion on the ion beam axis in the Q-TOF mass spectrometer in the present embodiment.
Figure 2B:
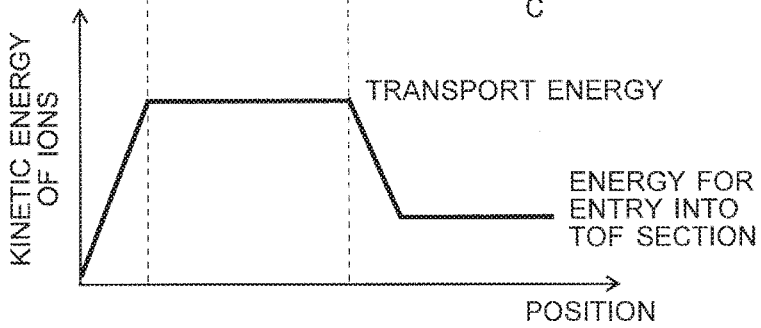

FIG. 2A is a diagram showing the configuration of the ion optical system between the collision cell 16 and the orthogonal accelerator 24 shown in FIG. 1. FIG. 2B is a diagram showing a change in the kinetic energy possessed by an ion on the ion beam axis C.

The converging electrode 18 located immediately behind the exit end of the collision cell 16 is a plate-shaped electrode having a large circular opening centered on the ion beam axis C. The accelerating electrode 19 located further behind is a plate-shaped electrode having a micro-sized ion-passage opening 19*a* centered on the ion beam axis C. The electrostatic ion lens system 20 and the rear-side ion transport optical system 23 each include one or more plate-shaped electrodes each of which has a large circular opening centered on the ion beam axis C. A predetermined direct voltage is applied from the voltage generator 31 to each of those electrodes as well as the exit electrode 16*a* of the collision cell 16, partition wall 22, and ion entrance electrode 241 of the orthogonal accelerator 241.

For convenience of explanation, it is hereinafter assumed that the ion to be subjected to the measurement is a positive ion. It is evident that the polarity of the voltages and other relevant elements only need to be reversed in the case where the ion to be subjected the measurement is a negative ion.

The accelerating electrode 19 is supplied with a voltage which is considerably low relative to the voltage applied to the exit electrode 16*a* of the collision cell 16. As a result, an accelerating electric field for extracting and accelerating positive ions from the collision cell 16, i.e. for giving a considerable amount of kinetic energy to those ions, is formed within the space between the exit electrode 16*a* of the collision cell 16 and the accelerating electrode 19. On the other hand, the converging electrode 18 is supplied with an appropriate amount of direct voltage having the same polarity as the ion, i.e. positive polarity, whereby a converging electric field is created near the opening of the converging electrode 18.

Since the opening of the converging electrode is large, the converging electric field has the effect of curving the trajectories of the ions passing near the edge of the opening so that those ions come closer to the ion beam axis C, whereas this effect of the converging electric field barely reaches the ions travelling in an area near the ion beam axis C. By comparison, the accelerating electric field effectively works even in the inner area of the opening of the converging electrode 18. As a result, the ions extracted from the collision cell 16 are converged into an area near the ion beam axis C while being accelerated by the accelerating electric field, so that the ions can efficiently pass through the micro-sized ion-passage opening 19*a*. Meanwhile, CID gas is continuously or intermittently supplied into the collision cell 16. This gas flows from the exit opening of the collision cell 16 to its outside (into the third intermediate vacuum chamber 5), forming a gas stream toward the partition wall 22. However, this gas stream cannot easily pass through the ion-passage opening 19*a* formed in the accelerating electrode 19, since this opening is extremely small, as noted earlier. Consequently, the amount of residual gas within the space between the accelerating electrode 19 and the partition wall 22 becomes smaller than in the other areas within the third intermediate vacuum chamber 5. Accordingly, the ions which have passed through the ion-passage opening 19*a* have less chance of colliding with the residual gas than in the case where there is no blockage of gas by the accelerating electrode 19.

Despite that, as compared to the high-vacuum chamber 6, a significant amount of residual gas still exists within the space between the accelerating electrode 19 and the partition wall 22. Therefore, the ions passing through this space will inevitably collide with the residual gas. To address this problem, in the present Q-TOF mass spectrometer, a large difference in voltage is set between the accelerating electrode 19 and the exit electrode 16*a* of the collision cell 16 in order to impart a sufficiently large amount of kinetic energy to the ions by the accelerating electric field as compared to the amount of kinetic energy that the ions must have when entering the orthogonal accelerator 24. Since the ions which have passed through the accelerating electrode 19 each have a considerable amount of kinetic energy, the ions will neither significantly change their trajectories nor significantly lose their kinetic energy even if they collide with the residual gas. Under the effect of the converging electric field created by the positive voltage applied to the electrostatic ion lens system 20, the ions will converge into an area near the ion beam axis C. Thus, despite the use of the simply-structured electrostatic ion lens system 20, the ions can be efficiently converged and made to pass through the ion-passage hole 22*a* within the third intermediate vacuum chamber 5 in which the degree of vacuum is not very high.

Within the high-vacuum chamber 6, a decelerating electric field is created by the voltages applied to the rear-side ion transport optical system 23. Due to this electric field, the kinetic energy of the ions is rapidly decreased to a predetermined level, as shown in FIG, 2B. Simultaneously, the cross section of the ion beam is shaped into a suitable size and shape for its introduction into the orthogonal accelerator 24. That is to say, the shaping of the ion beam as well as the adjustment of the kinetic energy possessed by the ions are performed within the high-vacuum chamber 6 in which the collision of the ions with the gas is inconsequential. Thus, a highly efficient transport of the ions using an electrostatic ion lens is achieved within both the third intermediate vacuum chamber 5 on the front side of the partition wall 22 and the high-vacuum chamber 6 on the rear side of the same wall, whereby a greater amount of ions can be introduced into the orthogonal accelerator 24.

Figure 3:
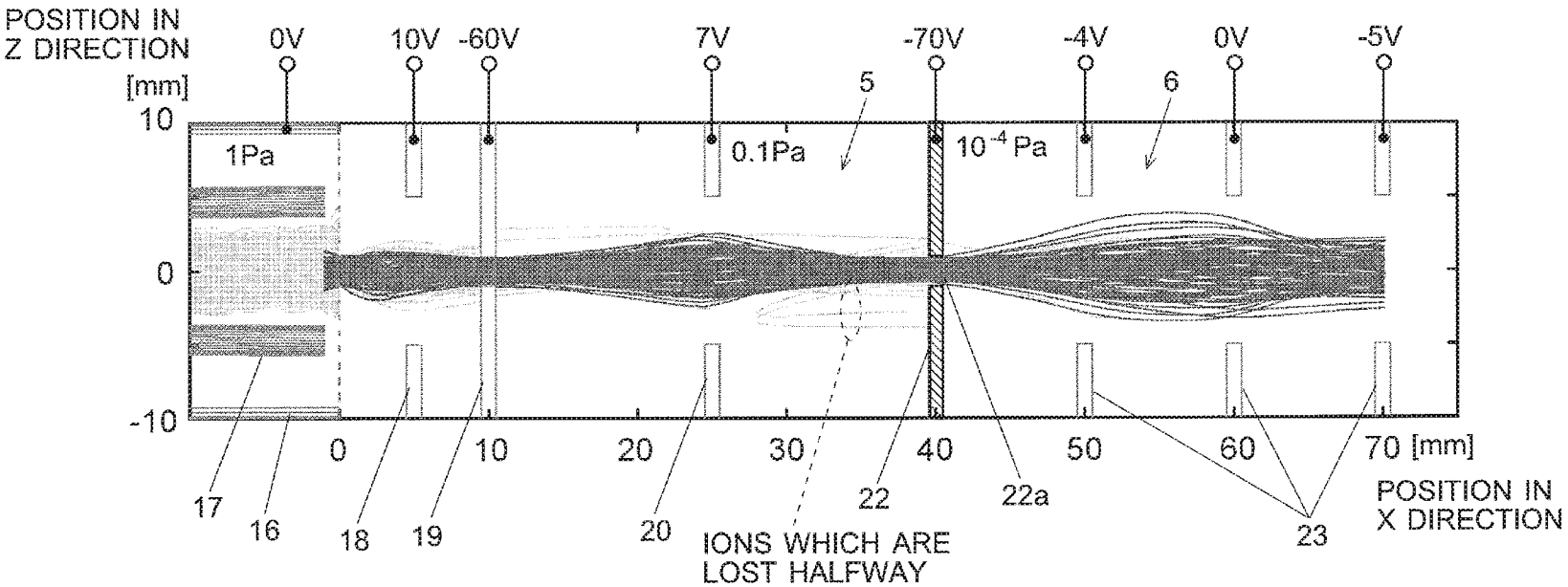
FIG. 3 is a diagram showing the result of a simulation of the ion trajectory between the collision cell and the orthogonal accelerator in the Q-TOF mass spectrometer in the present embodiment.

FIG. 3 shows the result of a simulation of the ion trajectory in the previously described ion optical system. As described in the figure, the simulation was conducted under the condition that the gas pressure in the collision cell 16 was 1 Pa, the gas pressure in the third intermediate vacuum chamber 5 was 0.1 Pa, and the gas pressure in the high-vacuum chamber 6 was $10^{-4}$ Pa. The kinetic energy of the ions entering the orthogonal accelerator (not shown in FIG.

3) was assumed to be 5 eV. With the potential of the exit electrode 16*a* of the collision cell 16 defined as 0 V, the potential of the rearmost lens electrode of the rear-side ion transport optical system 23 was set at −5 V. The potential of the accelerating electrode 19 was set at −60 V. That is to say, the ions which had passed through the accelerating electrode 19 had a kinetic energy of 60 eV, which was dramatically higher than the eventually required amount of energy, to pass through the medium-vacuum region (and through the ion-passage hole 22*a*). Each of the electrodes shown in the figure was a simple aperture electrode having a circular opening.

In FIG. 3, the trajectories of the ions which successfully reached the rearmost lens electrode in the high-vacuum chamber 6 are represented by dark-colored lines, while those of the ions which were lost halfway are represented by light-colored lines. The collision of ions with neutral gas depending on the degree of vacuum was considered in this simulation of the ion trajectory. Some of the ions underwent a change in their trajectories due to the collision with the neutral gas within the third intermediate vacuum chamber 5 behind the accelerating electrode 19, failing to pass through the ion-passage hole 22*a* due to the collision with the partition wall 22 or other reasons. However, most of the ions passed through the ion-passage hole 22*a* and were transported into the high-vacuum chamber 6. According to a rough calculation by the present inventors, the transmittance of the ions after their passage through the accelerating electrode 19 had a considerably high value of approximately 90%. Accordingly, it is possible to conclude that the ion optical system in the present embodiment can achieve a sufficient level of ion transmittance within the medium-vacuum region in which the collision with gas must be considered, by using a simple electrostatic ion lens system which does not utilize a radio-frequency electric field.

The previous embodiment is concerned with the case of applying the present invention in a Q-TOF mass spectrometer. The present invention can be applied in various configurations of mass spectrometers in which the configuration of a differential pumping system including a medium-vacuum region and high-vacuum region separated by a partition wall is adopted.

On example is a Fourier transform ion cyclotron resonance mass spectrometer in which ions are made to rotate within an ICR cell and the thereby induced electric current is measured. If the ions come in contact with residual gas and their oscillation is thereby damped, the resolving power will be restricted. Therefore, as with the time-of-flight mass separator, it is necessary to place the ICR cell within a high-vacuum chamber. Furthermore, in the case where ions produced by fragmentation within a collision cell are introduced into the ICR cell for mass spectrometry, it is necessary to place the collision cell within a medium-vacuum region and the ICR cell within a high-vacuum region, as in the previous embodiment. Accordingly, a similar ion optical system to the previous embodiment can be applied in the section between the collision cell and the ICR cell.

A similar ion optical system to the previous embodiment is also useful in a device which uses different components in place of a quadrupole mass filter and a collision cell as used in the previous embodiment. One example is a device in which an ion guide having the function of a linear ion trap is placed within the medium-vacuum region, and ions which have been temporarily trapped within the ion guide are ejected from the ion trap into the time-of-flight mass separator for mass spectrometry. In summary, the present invention can be generally applied in any type of mass spectrometer to obtain the previously described effect as long as the mass spectrometer is constructed as a multistage differential pumping system in which a time-of-flight mass separator, ICR cell or similar device is located within the vacuum chamber in the last stage, i.e. in which the vacuum chamber in the last stage needs to be maintained at a considerably high degree of vacuum.

The previously described embodiment a mere example of the present invention, and any change, modification appropriately made within the spirit of the present invention will naturally fall within the scope of claims of the present application.

REFERENCE SIGNS LIST

1 . . . Chamber
2 . . . Ionization Chamber
3 . . . First Intermediate Vacuum Chamber
4 . . . Second Intermediate Vacuum Chamber
5 . . . Third Intermediate Vacuum Chamber
6 . . . High-Vacuum Chamber
10 . . . ESI Spray
11 . . . Heated Capillary
12, 14 . . . Ion Guide
13 . . . Skimmer
15 . . . Quadrupole Mass Filter
16 . . . Collision Cell
16*a* . . . Exit Electrode
17 . . . Multipole Ion Guide
18 . . . Converging Electrode
19 . . . Accelerating Electrode
20 . . . Electrostatic Ion Lens System
21 . . . Front-Side Ion Transport Optical System
22 . . . Partition Wall
22*a* . . . Ion-Passage Hole
23 . . . Rear-Side Ion Transport Optical System
24 . . . Orthogonal Accelerator
241 . . . Ion Entrance Electrode
242 . . . Push-Out Electrode
243 . . . Extracting Electrode
25 . . . Flight Space
26 . . . Reflector
27 . . . Back Plate
28 . . . Ion Detector
30 . . . Controller
31 . . . Voltage Generator
C . . . Ion Beam Axis

The invention claimed is:

1. A mass spectrometer constructed as a differential pumping system including a medium-vacuum region and a high-vacuum region separated by a partition wall having an ion-passage hole, the mass spectrometer having an ion transport path for guiding ions from a front-side ion optical system located within the medium-vacuum region through the ion-passage hole into the medium-vacuum region to introduce the ions into a rear-side ion optical system located within the high-vacuum region, and the mass spectrometer comprising:

a) a front-side ion transport optical system which is an electrostatic ion lens located between the front-side ion optical system and the partition wall, including: an accelerating electrode having a micro-sized ion-passage opening and located on an entrance side of the front-side ion transport optical system, for extracting ions from the front-side ion optical system and accelerating the ions; and a converging electrode located between the accelerating electrode and the front-side ion optical system, for converging ions extracted from the front-side ion optical system so as to make the ions pass through the ion-passage opening of the accelerating electrode;

b) a rear-side ion transport optical system which is an electrostatic ion lens located between the partition wall and the rear-side ion optical system; and c) a voltage supplier for applying a direct voltage to each of members constituting the front-side ion optical system, the front-side ion transport optical system, the partition wall, and the rear-side ion transport optical system, the voltage supplier configured to apply a voltage to each relevant element so that: an accelerating electric field for accelerating ions is created within a space between the front-side ion optical system and the accelerating electrode; an electric field for converging ions is created near the converging electrode within the aforementioned space; a converging electric field for focusing ions into the ion-passage hole while maintaining kinetic energy possessed by the ions is created within a space between the accelerating electrode and the partition wall; and a decelerating electric field for reducing the kinetic energy of the ions by an amount smaller than the kinetic energy imparted to the ions within the accelerating electric field is created within a space between the partition wall and the rear-side ion optical system.

2. The mass spectrometer according to claim 1, wherein: the front-side ion optical system is a collision cell for fragmenting ions by collision induced dissociation, and the rear-side ion optical system is an orthogonal accelerator in an orthogonal acceleration time-of-flight mass separator.

3. The mass spectrometer according to claim 1, wherein: the front-side ion optical system is a collision cell for fragmenting ions by collision induced dissociation, and the rear-side ion optical system is a Fourier transform mass spectrometer.

4. The mass spectrometer according to claim 1, wherein: the front-side ion optical system is an ion-holding unit, the rear-side ion optical system is an orthogonal accelerator in an orthogonal acceleration time-of-flight mass separator, and an ion source for generating ions is an atmospheric pressure ion source.

* * * * *